US007624475B2

(12) United States Patent
Choi

(10) Patent No.: US 7,624,475 B2
(45) Date of Patent: Dec. 1, 2009

(54) UPRIGHT TYPE VACUUM CLEANER CAPABLE OF BEING CONVERTED TO CANISTER TYPE

(75) Inventor: Im Suk Choi, Incheon-si (KR)

(73) Assignee: Ace Electronics Co., Ltd., Yongin-si, Gyeonggi-do (KR)

( * ) Notice: Subject to any disclaimer, the term of this patent is extended or adjusted under 35 U.S.C. 154(b) by 267 days.

(21) Appl. No.: 11/504,586

(22) Filed: Aug. 16, 2006

(65) Prior Publication Data

US 2007/0039121 A1 Feb. 22, 2007

(30) Foreign Application Priority Data

Aug. 18, 2005 (KR) ..... 10-2005-0075733
Aug. 18, 2005 (KR) ..... 10-2005-0075734

(51) Int. Cl.
*A47L 5/00* (2006.01)

(52) U.S. Cl. ..... 15/335; 15/331; 15/334

(58) Field of Classification Search ..... 15/328, 15/329, 331, 334, 335; *A47L 5/00*
See application file for complete search history.

(56) References Cited

U.S. PATENT DOCUMENTS 4,571,772 A * 2/1986 Dyson ..... 15/335
5,309,600 A 5/1994 Weaver et al.
5,524,321 A 6/1996 Weaver et al.
5,715,566 A 2/1998 Weaver et al.
6,058,559 A * 5/2000 Yoshimi et al. ..... 15/328
7,350,263 B2 * 4/2008 Yoshimi et al. ..... 15/331
7,356,874 B2 * 4/2008 Skinner Macleod et al. ... 15/328
2006/0026789 A1 * 2/2006 Fischer et al. ..... 15/334

* cited by examiner

*Primary Examiner*—David A Redding
(74) *Attorney, Agent, or Firm*—The Nath Law Group; Jerald L. Meyer; Sungyeop Chung

(57) ABSTRACT

Disclosed herein is an upright type vacuum cleaner capable of being converted to a canister type. The vacuum cleaner comprises a main body having a suction port and a discharge port, a suction unit having a dust collecting port and a discharge opening, and on which the main body is rotatably installed, a handle installed to the main body, an extension pipe disposed between the handle and the main body and having a hollow inner space to define a flow passage for foreign substances, a securing mechanism between the extension pipe and the main body to restrict a circumference of the extension pipe, a cover installed at a portion of the main body where the securing mechanism and a lower end of the extension pipe are disposed, and an attaching mechanism between the securing mechanism and the cover to allow the extension pipe to be detached from the securing mechanism.

14 Claims, 8 Drawing Sheets

UPRIGHT TYPE VACUUM CLEANER CAPABLE OF BEING CONVERTED TO CANISTER TYPE

BACKGROUND OF THE INVENTION

1. Field of the Invention

The present invention relates to an upright type vacuum cleaner, and, more particularly, to an upright type vacuum cleaner, which comprises an extension pipe constructed to permit installation of a handle, a suction hose or a suction head thereto while acting as a flow passage through which foreign substances are induced, so that, when the suction hose and the suction head are coupled to the extension pipe, the upright type vacuum cleaner is converted to a canister type.

2. Description of the Related Art

A vacuum cleaner is a household appliance which sucks dust and other foreign substances scattered on floors, walls, small gaps and the like in a room via a strong suction force from a negative pressure generated by driving a fan motor and operating a vacuum pump, and then collects the dust and the other foreign substances using a dust collecting filter positioned therein.

According to shapes and using postures, the vacuum cleaners can be classified into a canister type vacuum cleaner, which provides convenience in corner cleaning and movement while allowing easy replacement of a brush and a nozzle, and an upright type vacuum cleaner, which provides convenience in maintenance and allows easy cleaning of a large space.

FIG. 1 is a perspective view illustrating a conventional upright type vacuum cleaner.

The conventional upright type vacuum cleaner comprises a suction unit 100 having wheels 105 attached to a lower surface thereof and serving to suck dust on a floor, a main body 200 having components such as motor and the like contained therein, and an upright type handle 300.

For the upright type vacuum cleaner constructed as above, the suction unit 100 is formed at the lower surface with a suction port (not shown) to which a brush is attached and through which dust removed by the brush is sucked into the suction unit. Then, the sucked dust flows along with air and is collected via a filter, while the air is discharged to the outside.

The conventional upright type vacuum cleaner has a merit in that, since the suction unit has a wider area than an associated portion of the main body to allow the vacuum cleaner to stand upright thereon, the conventional upright type vacuum cleaner is able to clean a wider area in a room while moving thereon, and can be maintained in an upright state after finishing the cleaning operation.

However, since it is necessary to perform the cleaning operation with the suction unit facing a floor, it is difficult to perform the cleaning operation of narrow spaces such as corners or gaps between pieces of furniture.

In addition, since the main body has a relatively heavy weight and is maintained in the upright state by the suction unit, it is difficult to clean or replace a roller and a filter which are installed to a suction port through which the foreign substances are induced. Accordingly, there is a need of an improved vacuum cleaner which overcomes these problems.

SUMMARY OF THE INVENTION

Therefore, the present invention has been made in view of the above problems, and it is an object of the present invention to provide an upright type vacuum cleaner capable of being converted to a canister type, which comprises a handle detachably installed to a main body while defining a flow passage through which foreign substances are induced, such that a suction head and a suction hose are coupled to the handle, thereby allowing easy conversion of the vacuum cleaner from the upright type to the canister type or vice versa.

In accordance with one aspect of the present invention, the above and other objects can be accomplished by the provision of an upright type vacuum cleaner capable of being converted to a canister type, comprising: a main body having a suction port and a discharge port, and including a suction device inside the suction port; a suction unit having a dust collecting port and a discharge opening, and on which the main body is detachably installed; a handle installed at an upper portion of the main body; an extension pipe detachably installed to the main body between the handle and the main body, and having a hollow inner space to define a flow passage into which foreign substances are induced; a securing mechanism installed between the extension pipe and the main body to restrict a circumference of the extension pipe; and a suction hose connected at one end with the suction port, and selectively connected at the other end with the discharge opening or the handle.

Preferably, the upright type vacuum cleaner further comprises a cover installed at a portion of the main body where the securing mechanism and the extension pipe are disposed. In addition, preferably, the upright type vacuum cleaner further comprises an attaching mechanism installed between the securing mechanism and the cover to allow the extension pipe to be detached from or attached to the securing mechanism by manipulation of a user.

Preferably, the handle is formed with a fastening hole section located above an upper end of the extension pipe when the handle is coupled to the extension pipe, and to which the suction hose is coupled to communicate with the extension pipe through the fastening hole section.

Preferably, the extension pipe is provided with a securing protrusion at a portion thereof corresponding to the securing mechanism such that the securing protrusion is protruded from or retracted into the extension pipe in a lateral direction, and with a C-shaped spring between an inner end of the securing protrusion and an inner wall of the extension pipe. Preferably, the securing mechanism comprises a seating part recessed into one side of the main body, a semicircular-shaped frame having both ends fastened to the seating part to restrict the circumference of the extension pipe, and a latch hole formed through the frame and into which the securing protrusion is fitted.

Preferably, the cover is provided with a plurality of wheels.

Preferably, the attaching mechanism comprises a through-hole formed on the cover corresponding to the latch hole, a knob retractably installed to the through-hole, and a spring disposed between the knob and the cover.

In accordance with another aspect of the present invention, an upright type vacuum cleaner capable of being converted to a canister type is provided, which comprises: a main body having a suction port and a discharge port, and including a suction device inside the suction port; a suction unit having a dust collecting port and a discharge opening, and on which the main body is detachably installed; an extension pipe detachably installed to the main body, and having a hollow inner space to define a flow passage into which foreign substances are induced; a handle installed to an upper end of the extension pipe to form an extend flow passage into which the foreign substances are induced; and a suction hose connected at one end with the suction port, and selectively connected at the other end with the discharge opening or the handle.

Preferably, the handle comprises a handle body installed to the upper end of the extension pipe and adapted to define an extended portion of the flow passage through which the foreign substances are induced; a movement prevention mechanism installed between the handle body and the extension pipe; and a handle cover installed to a front side of the handle body to hold the movement prevention mechanism and the handle body.

Preferably, the handle body has threads formed around an outer wall of a lower end so as to be fastened by a securing cap of the movement prevention mechanism, and a fastening hole section having a latch groove formed on an inner wall of an upper end of the fastening hole section such that the suction hose is coupled to the fastening hole section to define the extended portion of the flow passage through which the foreign substances are induced.

Preferably, the movement prevention mechanism comprises seating grooves formed on an upper circumference of the extension pipe, a securing clip fitted into the seating grooves, an insertion hole formed on the handle body and through which the securing clip penetrates, and a securing cap to restrict the handle body and the handle cover enclosing the securing clip and the insertion hole. Preferably, the seating grooves comprise a pair of grooves depressed into the upper circumference of the extension pipe, elongated in a horizontal direction, and spaced a predetermined distance from each other. Preferably, the securing clip has a C-shape such that both ends of the securing clip are fitted into the seating grooves.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the accompanying drawings as follows.

Figure 1:
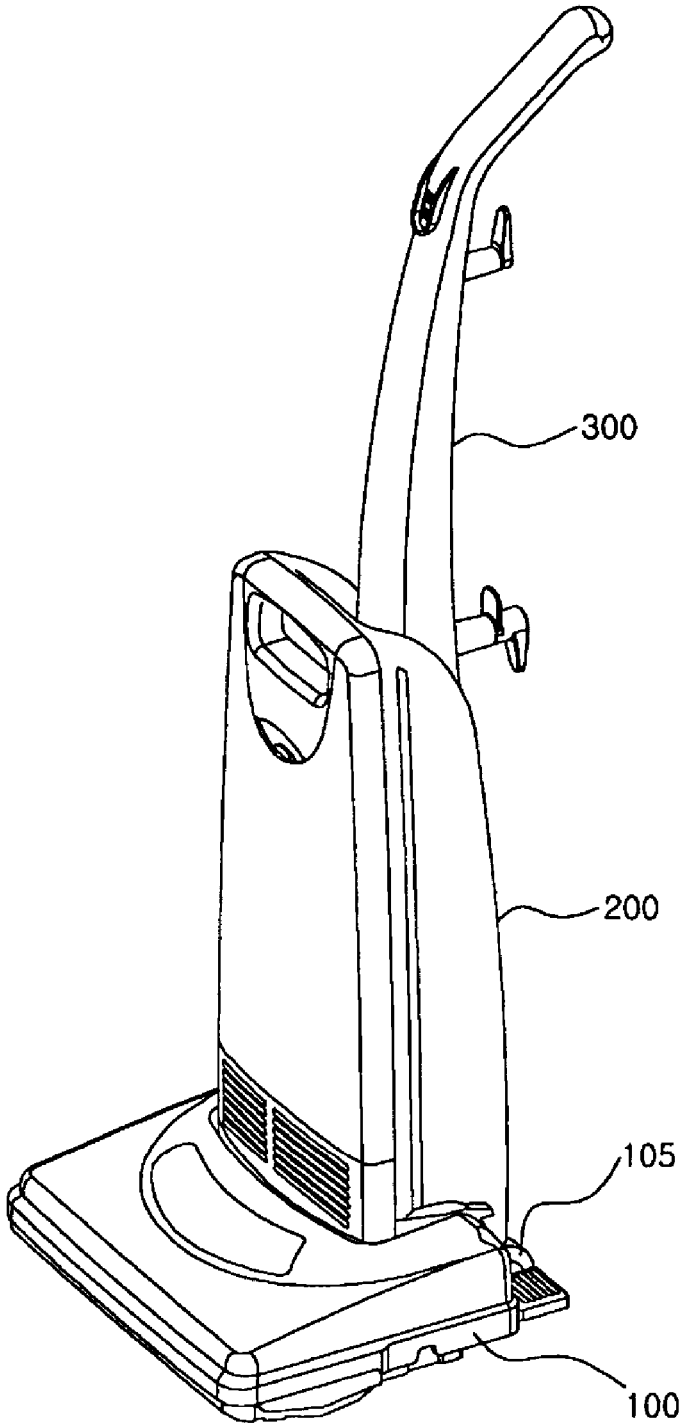
FIG. 1 (Prior Art)
FIG. 1 is a perspective view illustrating a conventional upright type vacuum cleaner.
Figure 2:
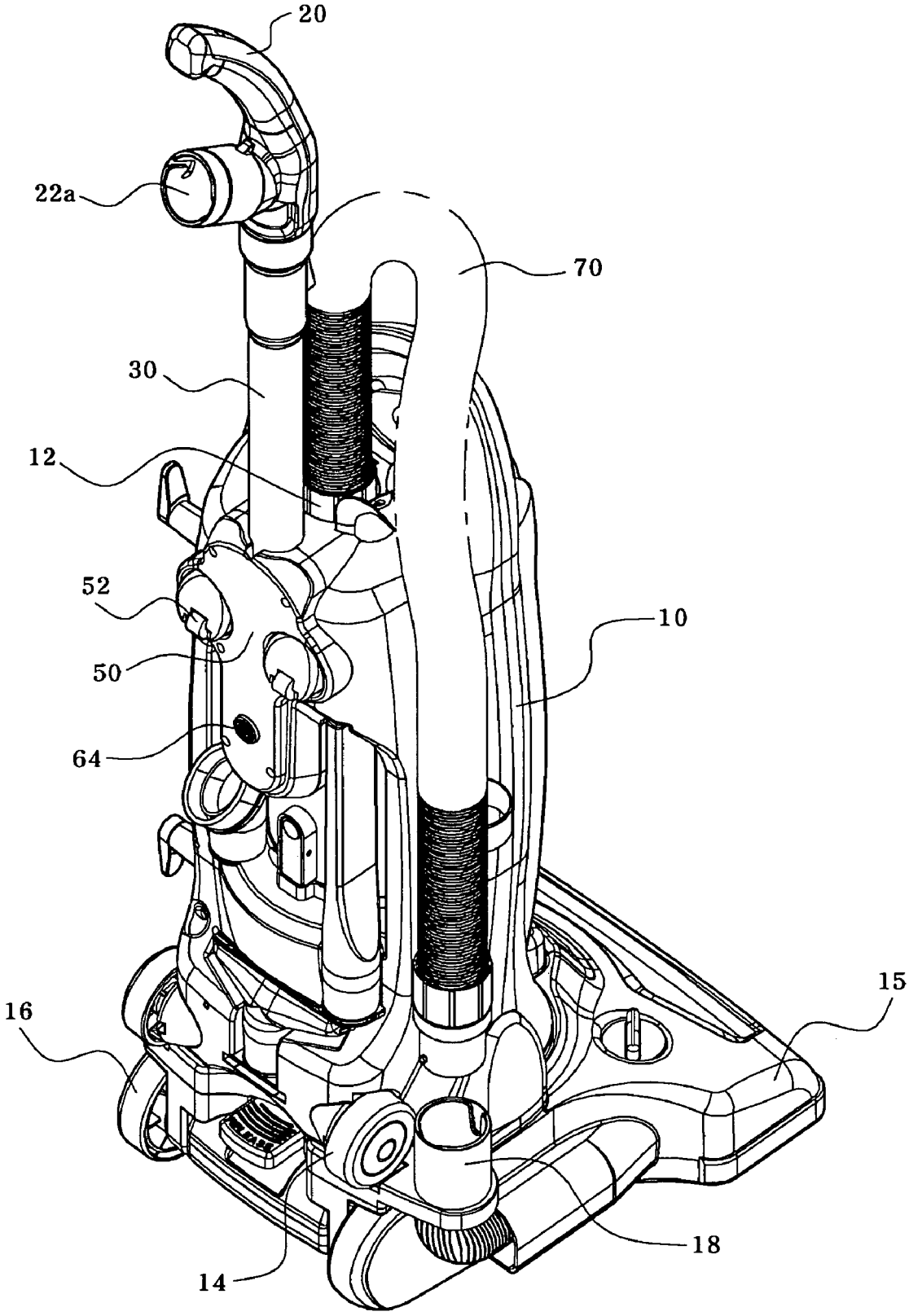
FIG. 2 is a perspective view illustrating an upright type vacuum cleaner capable of being converted to a canister type according to the present invention.

FIG. 2 is a perspective view illustrating an upright type vacuum cleaner capable of being converted to a canister type according to the present invention.

An upright type vacuum cleaner capable of being converted into a canister type vacuum cleaner according to the present invention comprises: a main body 10 having a predetermined space defined therein, having a suction port 12 and a discharge port 13, and including a suction device inside the suction port 12; a suction unit 15 having a dust collecting port (not shown) and a discharge opening 18, and on which the main body is detachably installed to stand upright; a suction hose 70 installed between the suction port 12 and the discharge opening 18; a handle 20 attached to an upper portion of the main body 10; an extension pipe 30 detachably installed to the main body 10 between the handle 20 and the main body 10, and having a hollow inner space to define a flow passage into which foreign substances are induced; a securing mechanism 40 installed between the extension pipe 30 and the main body 10 to restrict a circumference of the extension pipe 30; a cover 50 installed at a portion of the main body 10 where the securing Mechanism 40 and a lower end of the extension pipe 30 are disposed; and an attaching mechanism 60 installed between the securing mechanism 40 and the cover 50 to allow the extension pipe 30 to be attached to or detached from the securing mechanism 40 by manipulation of a user.

Figure 5:
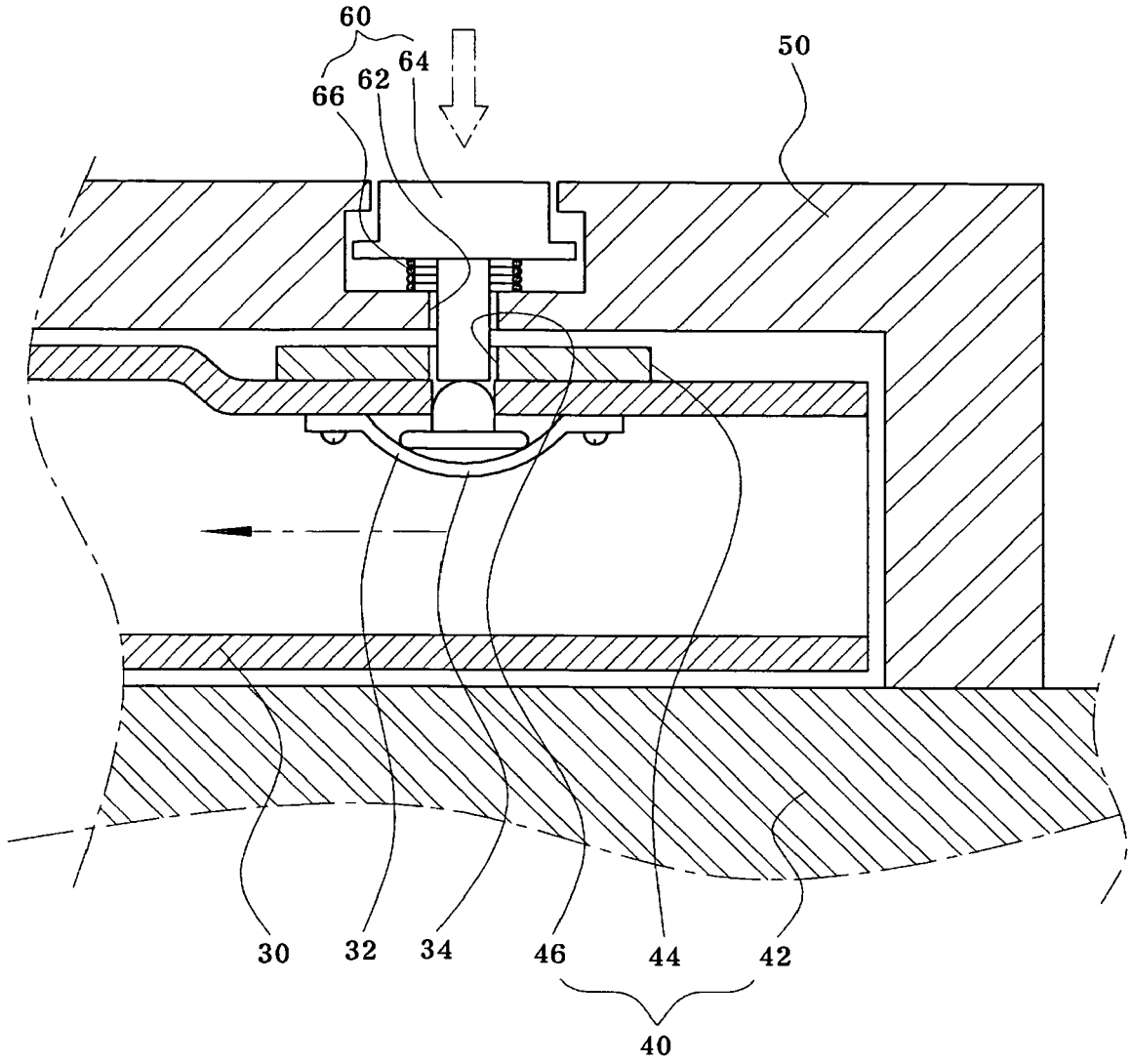
FIG. 5 is a cross-sectional view illustrating the securing mechanism and the attaching mechanism in an operating state according to the present invention.

With this structure, when the suction hose 70 is fitted into the discharge opening 18 with the main body 10 seated on an upper surface of the suction unit 15, the vacuum cleaner becomes the upright type in which foreign substances and air suctioned through the dust collecting port of the suction unit 15 flow into the main body 10 through the suction port 12 via the discharge opening 18 and the suction hose 70. On the other hand, when the suction hose 70 is separated from the discharge opening 18 and coupled to the handle 20 with the main body 10 detached from the suction unit 15, the vacuum cleaner becomes the canister type, as shown in FIG. 5, in which the foreign substances and air flow along a suction passage extending from the extension pipe 30 to the main body 10 via the handle 20.

Referring to FIG. 2, the main body 10 has a vertically elongated space defined therein to receive a dust container and the suction device. The main body 10 has the suction port 12 formed at an upper surface, and the discharge port 13 formed at a front lower portion.

The suction unit 15 has a lower part wider than the main body 10 such that, when the main body 10 is coupled to the upper surface of the suction unit 15, it can stand upright. The dust collecting port is formed at a bottom surface of the suction unit 15, and the discharge opening 18 is formed at one side of an upper portion thereof such that the induced foreign substances and air are discharged therethrough. Thus, when the main body 10 is coupled to the upper surface of the suction unit 15, the vacuum cleaner becomes the upright type in which the foreign substances and air induced through the dust collecting port are suctioned into the main body 10 via the discharge opening 18 and the suction hose 70.

The handle 20 is formed with a fastening hole section 22*a* so as to locate above the upper end of the extension pipe 30 and to communicate with the extension pipe 30 when the handle 20 is coupled to the extension pipe 30, and to which the suction hose 70 is coupled. Thus, when the suction hose 70 is coupled to the fastening hole section 22*a*, cleaning operation can be performed such that foreign substances induced from the lower end of the extension pipe 30 flow along the extension pipe 30, and are then induced into the main body 10 through the suction hose 30 via the handle 20 and the fastening hole section 22*a*.

Figure 3:
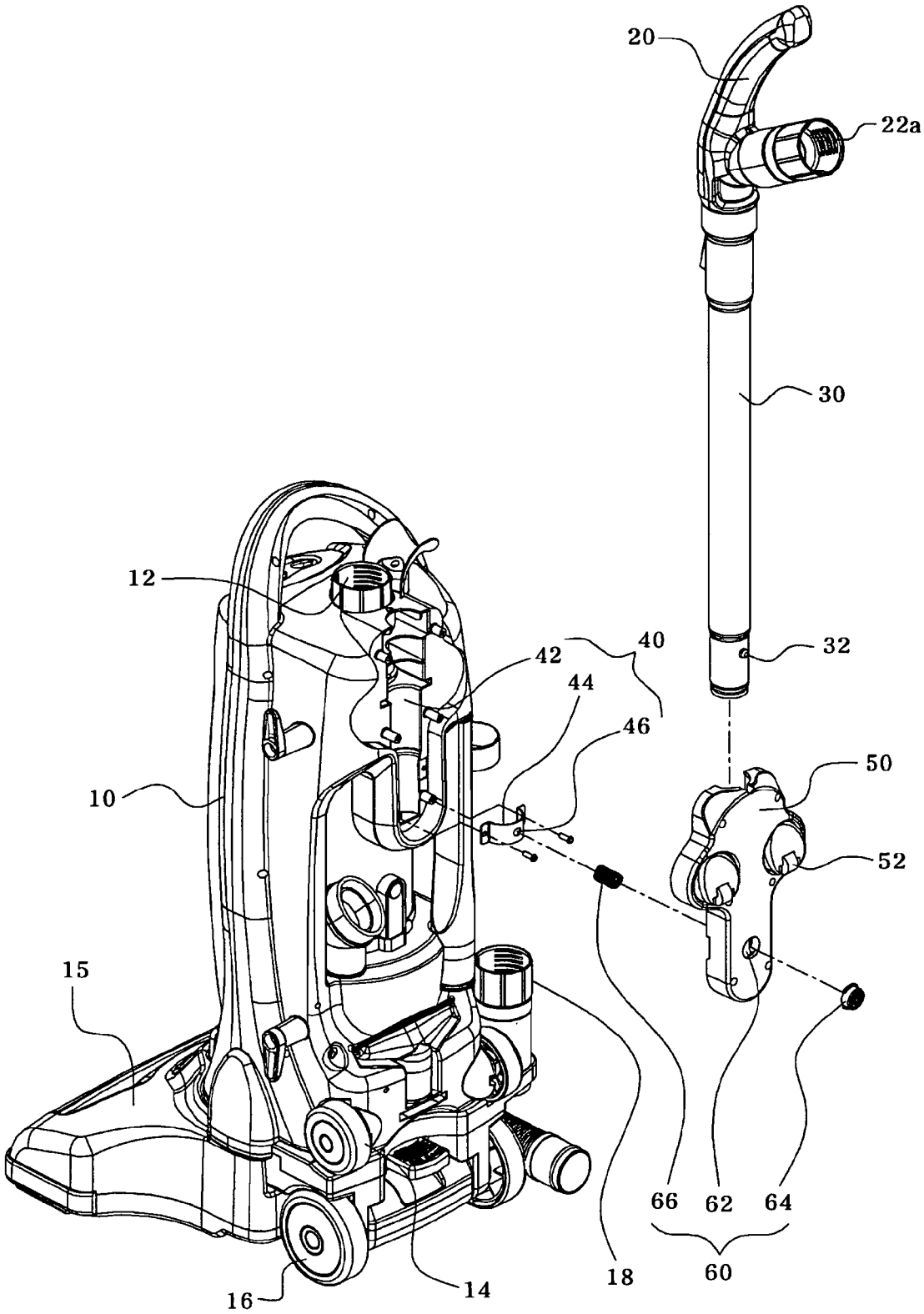
FIG. 3 is an exploded perspective view illustrating a securing mechanism and an attaching mechanism according to the present invention.
Figure 4:
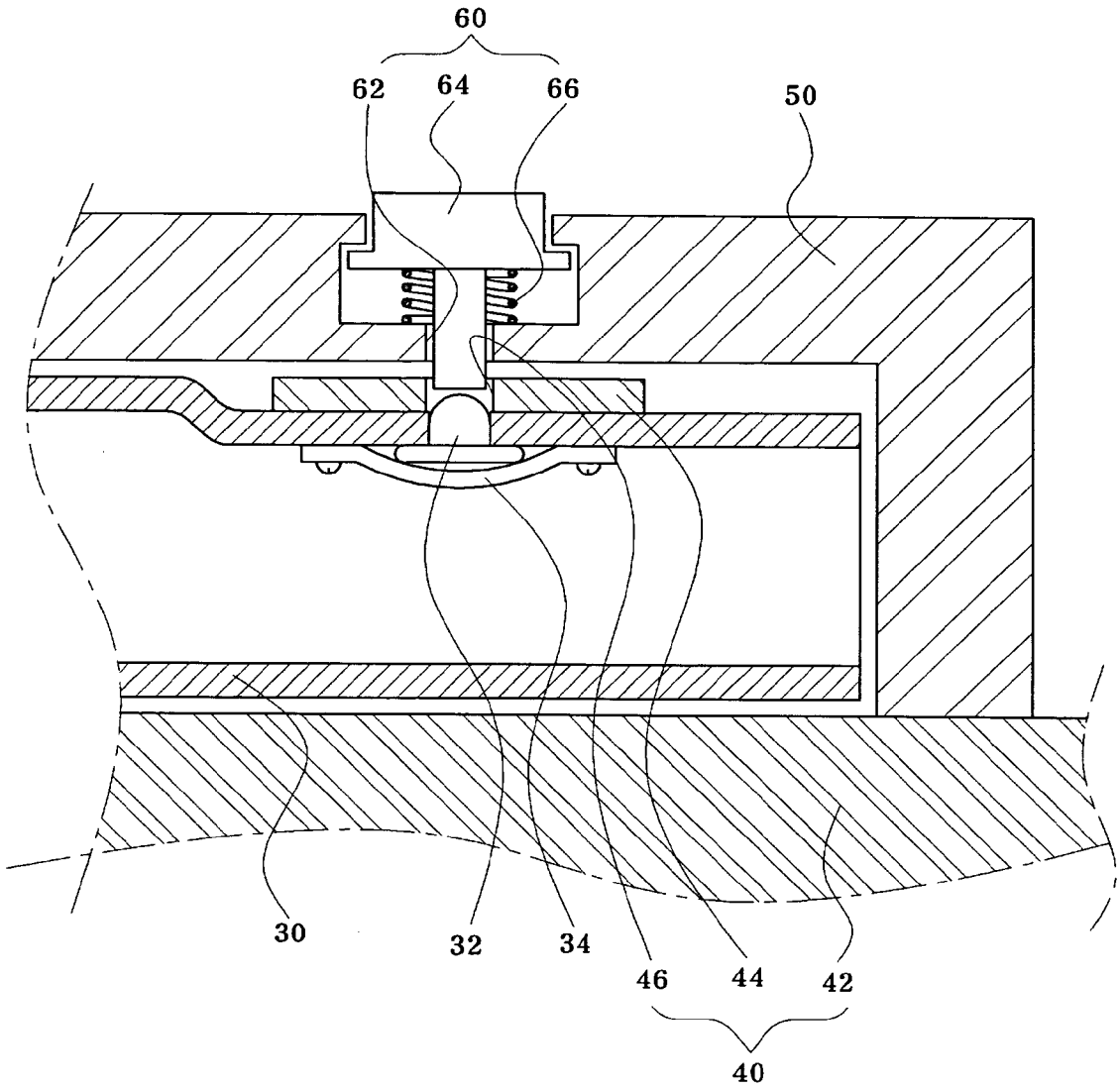
FIG. 4 is a cross-sectional view illustrating the securing mechanism and the attaching mechanism according to the present invention.

FIG. 3 is an exploded perspective view illustrating the securing mechanism and the attaching mechanism according to the present invention, and FIG. 4 is a cross-sectional view illustrating the securing mechanism and the attaching mechanism according to the present invention.

The extension pipe 30 is provided with a securing protrusion 32 at a lower portion thereof corresponding to the securing mechanism 40 such that the securing protrusion 32 can be protruded from or retracted into the extension pipe 30 in a lateral direction, and with a C-shaped spring 34 between an inner end of the securing protrusion 32 and an inner wall of the extension pipe 30, as shown in FIGS. 4 and 5, to impart a resilient force to the securing protrusion 32 while minimizing flow resistance within the extension pipe 30.

The securing mechanism 40 comprises a recessed seating part 42 formed on an upper portion of the main body 10, a semicircular-shaped frame 44 having both ends fastened to the seating part 42 such that the lower end of the extension pipe 30 is inserted, and a latch hole 46 formed through the frame 44 and into which the securing protrusion 32 is fitted.

With this structure, while the extension pipe 30 is inserted inside the frame 44, the securing protrusion 32 is compressed into the extension pipe 30 by the frame 44, causing the C-shaped spring 34 to be compressed into the extension pipe 30, as shown in FIG. 5. When the extension pipe 30 is completely inserted inside the frame 44, the securing protrusion 32 is protruded to the outside of the latch hole 46 via a restoring force of the C-shaped spring 34, thereby allowing the extension pipe 30 to be completely installed to the main body.

Thus, when installing or separating the extension pipe 30 to or from the main body 10, the extension pipe 30 is mounted in a state wherein the circumference of the extension pipe 30 is restricted by the securing mechanism without changing the shape of the flow passage defined in the hollow extension pipe 30 or without inserting the securing mechanism 40 into the flow passage, so that the extension pipe 30 defining the flow passage for the foreign substances is prevented from being deformed or damaged by repetitious installation and separation of the extension pipe 30.

The cover 50 is provided on an outer wall with a plurality of wheels 52 such that, when the vacuum cleaner is used as the canister type with the main body 10 linearly disposed in the lateral direction on a floor of a room, the vacuum cleaner can be easily moved by means of the wheels. In addition, the cover 50 is formed with a slanted part 54 on an inner wall corresponding to the upper end of the frame 44 such that, when the extension pipe 30 is inserted between the seating part 42 and the cover 50, the protrusion 32 is compressed into the extension pipe 30 while passing the slanted part 54, thereby allowing the extension pipe 30 to be easily inserted inside the frame 44.

The attaching mechanism 60 comprises a through-hole 62 formed on the cover 50 corresponding to the latch hole 46, a knob 64 retractably installed to the through-hole 62, and a spring 66 disposed between the knob 64 and the cover 50. When pushing the knob 64, the securing protrusion 32 corresponding to an inner end of the knob 64 is compressed into the extension pipe 30 as shown in FIG. 5, thereby enabling the extension pipe 30 to be separated from the main body 10.

Operation of the upright type vacuum cleaner capable of being converted to the canister type according to the present invention will be described hereinafter.

When using the vacuum cleaner as the upright type, the extension pipe 30 is first inserted to the cover 50 and the securing mechanism 40. Then, as the extension pipe 30 passes the slanted part 54, the securing protrusion 32 is pushed by the slanted part 54, and retracted into the extension pipe 30, thereby compressing the C-shaped spring 34. When the extension pipe 30 is completely inserted thereto, the securing protrusion 32 is protruded to the outside of the latch hole 46 via restoring force of the C-shaped spring 34, thereby allowing the extension pipe 30 to be completely installed to the main body 10. As a result, the vacuum cleaner is converted to the upright type so that a user can perform a cleaning operation while moving the suction unit 15, via the wheels 16 installed to the suction unit 15, with the handle 20.

Then, when cleaning small spaces or gaps between pieces of furniture, the vacuum cleaner can be used after being converted to the canister type. To this end, the knob 64 is pushed such that the inner end of the knob 64 pushes the securing protrusion 32 into the extension pipe 30, thereby releasing vertical restriction of the extension pipe 30. Then, the lower end of the extension pipe 30 is detached from the frame 44 and the cover 50 by pulling the handle 20 upwardly.

Figure 6:
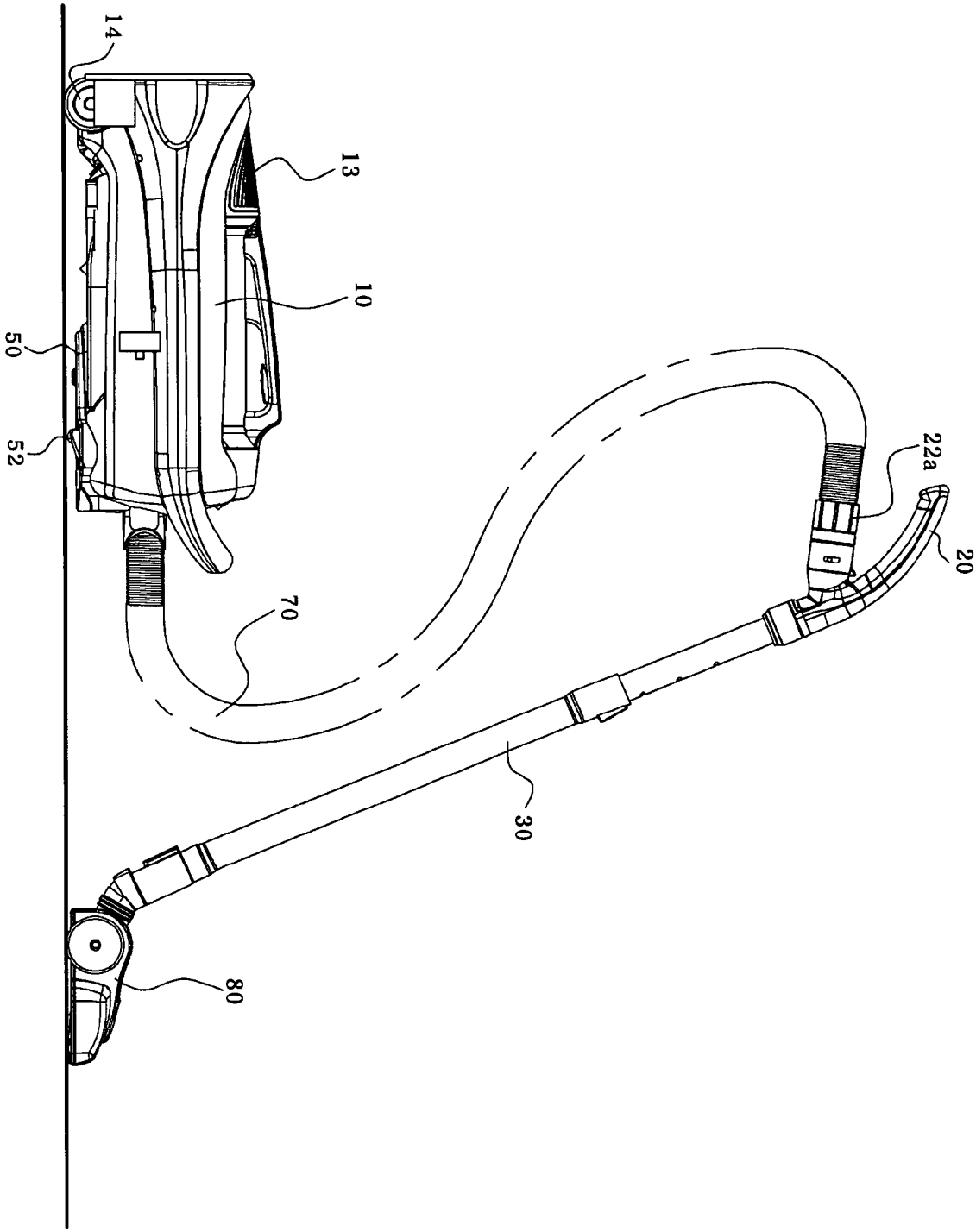
FIG. 6 is a view illustrating a using state of the upright type vacuum cleaner capable of being converted to the canister type according to the present invention.

Next, the suction hose 70 is installed between the fastening hole section 22*a* of the handle 20 detached from the main body 10 and the suction port 12, and a suction head 80 is installed to the lower end of the extension pipe 30, thereby constituting the canister type vacuum cleaner, as shown in FIG. 6, with which the cleaning operation is performed while moving the handle 20 and the extension pipe 30 with the main body 10 laid on the floor.

Figure 7:
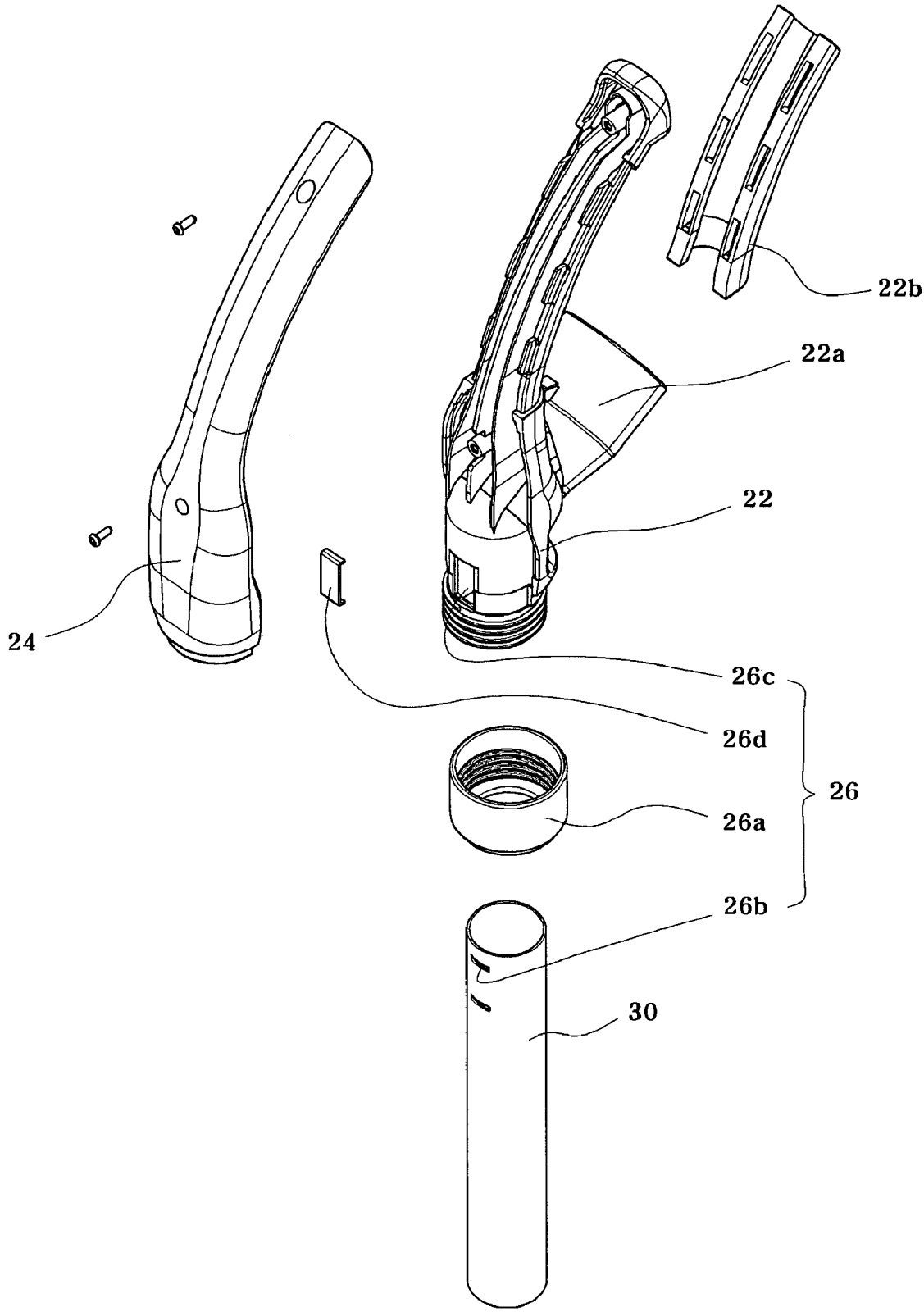
FIG. 7 is an exploded perspective view illustrating a handle of the upright type vacuum cleaner capable of being converted to the canister type according to the present invention.
Figure 8:
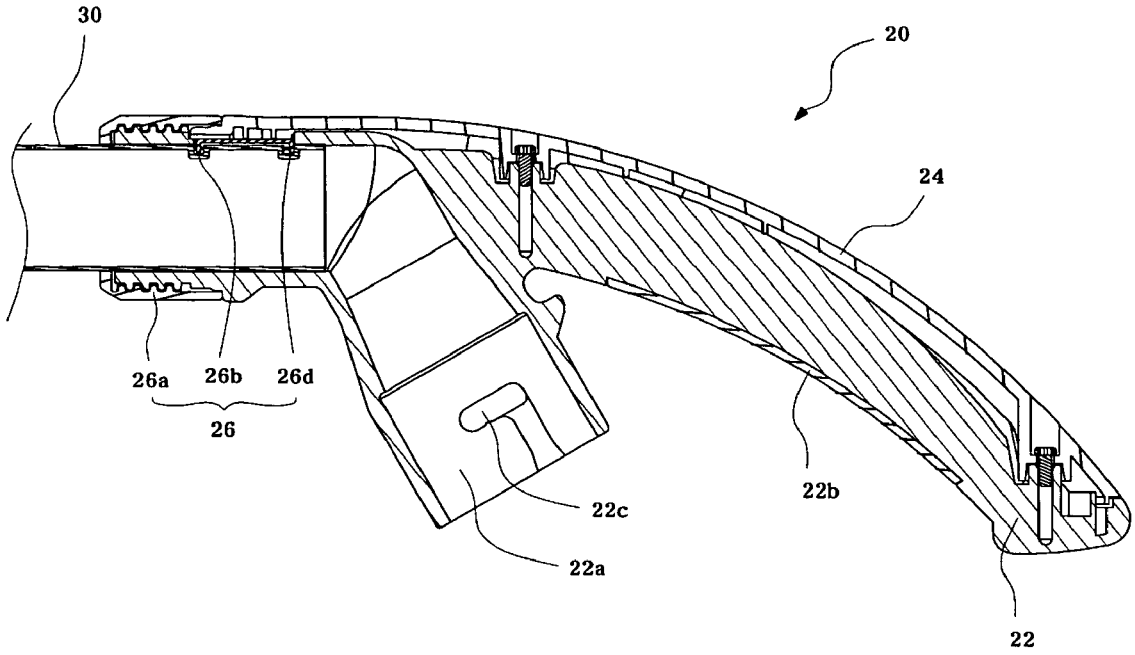
FIG. 8 is a cross-sectional view illustrating the handle of the upright type vacuum cleaner capable of being converted to the canister type according to the present invention.

FIG. 7 is an exploded perspective view illustrating the handle of the upright type vacuum cleaner capable of being converted to the canister type according to the present invention, and FIG. 8 is a cross-sectional view illustrating the handle of the upright type vacuum cleaner capable of being converted to the canister type according to the present invention.

The handle 20 comprises a handle body 22 installed to the upper end of the extension pipe 30 and adapted to define the flow passage through which the foreign substances are induced, a movement prevention mechanism 26 installed between the handle body 22 and the extension pipe 30, and a handle cover 24 installed to a front side of the handle body 22 to secure the movement prevention mechanism 26 to the handle body 22.

The handle body 22 is formed with threads around an outer wall of a lower end so as to be fastened by the movement prevention mechanism 26. In addition, the handle body 22 comprises the fastening hole section 22*a* having a latch groove 22*c* formed on an inner wall of an upper end of the fastening hole section 22*c* such that, when the suction hose 70 is coupled to the fastening hole section 22*c*, the fastening hole section 22*a* defines the flow passage through which the foreign substances are induced, and a grip section 22*b* of a soft material installed to a rear side of the upper portion of the handle body 22 where user's hand contacts.

With this structure, the handle body 22 and the handle cover 24 are installed to the upper end of the extension pipe 30 via the movement prevention mechanism 26, and the flow passage of the extension pipe 30 is communicated with the flow passage defined in the handle body 22. When the suction hose 70 is connected with the fastening hole section 22*a* of the handle body 22 in order to convert the vacuum cleaner, the handle 20 defines a singe flow passage along with the extension pipe 30 and the suction hose 70 to allow the foreign substances to be induced into the main body 10 therethrough, and enhances grip sensation via the grip section 22*b*.

As shown in FIG. 8, the movement prevention mechanism 26 comprises seating grooves 26*b* formed on an upper circumference of the extension pipe 30, a securing clip 26*d* fitted into the seating grooves 26*b*, an insertion hole 26*c* formed on the handle body 22 and through which the securing clip 26*d* penetrates, and a securing cap 26*a* to restrict the handle body 22 and the handle cover 24 enclosing the securing clip 26*d* and the insertion hole 26*c*.

The seating grooves 26*b* comprise a pair of grooves depressed into the upper circumference of the extension pipe 30, elongated in a horizontal direction, and spaced a predetermined distance from each other. The securing clip 26*d* has a C-shape such that both ends of the securing clip 26*d* are fitted into the seating grooves 26*b*.

With this structure, after inserting the securing cap 26*a* into the extension pipe 30, the handle body 22 is fitted into the extension pipe 30. At this time, with the insertion hole 26*c* disposed corresponding to the seating grooves 26*b*, the securing clip 26*d* is inserted into the seating grooves 26*b*, thereby preventing shaking of the handle body 22.

Then, the handle cover 24 is fastened to the front side of the handle body 22 via bolt fastening, so that the securing clip 26*d* is prevented from being detached, and so that the insertion hole 26*c* and the securing clip 26*d* are shielded by the handle cover 24, thereby providing an appealing appearance of the handle 20. Finally, the handle 20 is completely mounted to the extension pipe by fastening the securing cap 26*a* to the lower ends of the handle body 22 and the handle cover 24.

Operation of the upright type vacuum cleaner capable of being converted to the canister type according to the present invention will be described hereinafter.

Since the extension pipe 30 having the handle 20 attached thereto can be detachably installed to the main body 10 as described above, the extension pipe 30 is installed to the main body 10 in this state by the rear cover 50 as shown in FIG. 2 when a user want to use the vacuum cleaner as the upright type. Thus, the user can perform a cleaning operation while moving the main body 10, via the wheels 16 installed to the suction unit 15, with the handle 20.

In addition, the vacuum cleaner can be converted from the upright type to the canister type as follows. First, the extension pipe 30 is separated from the main body 10 by manipulating the knob 64. Then, the suction hose is detached from the discharge opening, and inserted into the fastening hole section 22*a* of the handle body 22. Finally, the main body 10 is separated from the suction unit 15, and laid on the floor, thereby constituting the canister type vacuum cleaner. In this state, a suction head 80 is coupled to the lower end of the extension pipe 30, thereby enabling an easy cleaning operation of narrow spaces such as a gap between pieces of furniture.

For the upright type vacuum cleaner capable of being converted to the canister type vacuum cleaner according to the present invention, a flow passage of foreign substances is formed through the extension pipe and the handle which can be detachably installed to the main body such that the vacuum cleaner can be used as the canister type or the upright type according to selection of installation of the suction hose by manipulation of a user, thereby providing advantageous effects in that, when cleaning a wide area, the vacuum cleaner is used as the upright type, enabling an easy cleaning operation of the wide area, and in that when suctioning foreign substances accumulated in a narrow space or a gap, the vacuum cleaner is used as the canister type, enabling a convenient cleaning operation.

In addition, according to the present invention, the vacuum cleaner comprises the securing mechanism which restricts the circumference of the extension pipe without being inserted into the extension pipe, and the attaching mechanism which enables easy separation of the extension pipe, thereby providing advantageous effects in that, when using the vacuum cleaner as the upright type, a clearance is not formed among the extension pipe, the handle and the main body, enabling a stable cleaning operation, and in that the flow passage of the extension pipe is prevented from being deformed or damaged by repetitious installation and separation of the extension pipe, extending a service life of the vacuum cleaner.

In addition, according to the prevent invention, the vacuum cleaner can be used as the canister type or the upright type according to the selection of installation of the suction hose to the main body by manipulation of the user, thereby providing advantageous effects in that, when cleaning the wide area, the vacuum cleaner is used as the upright type, enabling the easy cleaning operation of the wide area, and in that when suctioning the foreign substances accumulated in the narrow space or the gap, the vacuum cleaner is used as the canister type, enabling the convenient cleaning operation thereof.

Furthermore, according to the present invention, the handle body is securely installed to the upper end of the extension pipe, thereby providing advantageous effects in that, when using the vacuum cleaner as the upright type, a clearance is not formed among the extension pipe, the handle and the main body, enabling the stable cleaning operation, and in that the extension pipe and the handle are prevented not only from being deformed or damaged but also from having a clearance therebetween by repetitious installation and separation of the extension pipe, extending the service life of the vacuum cleaner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An upright type vacuum cleaner capable of being converted to a canister type, comprising:

a main body having a suction port and a discharge port, and including a suction device inside the suction port;

a suction unit having a dust collecting port and a discharge opening, and on which the main body is detachably installed;

a handle installed at an upper portion of the main body;

an extension pipe detachably installed to the main body between the handle and the main body, and having a hollow inner space to define a flow passage into which foreign substances are induced;

a securing mechanism installed between the extension pipe and the main body to restrict a circumference of the extension pipe; and a suction hose connected at one end with the suction port, and constructed so as to be capable of selective connection at the other end to each of the discharge opening and the handle.

2. The vacuum cleaner according to claim 1, further comprising:

a cover installed at a portion of the main body where the securing mechanism and the extension pipe are disposed.

3. The vacuum cleaner according to claim 2, further comprising:

an attaching mechanism installed between the securing mechanism and the cover to allow the extension pipe to be detached from or attached to the securing mechanism by manipulation of a user.

4. The vacuum cleaner according to claim 1, wherein the handle is formed with a fastening hole section located above an upper end of the extension pipe when the handle is coupled to the extension pipe, and to which the suction hose is coupled to communicate with the extension pipe through the fastening hole section.

5. The vacuum cleaner according to claim 1, wherein the extension pipe is provided with a securing protrusion at a portion thereof corresponding to the securing mechanism such that the securing protrusion is protruded from or retracted into the extension pipe in a lateral direction, and with a C-shaped spring between an inner end of the securing protrusion and an inner wall of the extension pipe.

6. The vacuum cleaner according to claim 5, wherein the securing mechanism comprises a seating part recessed into one side of the main body, a semicircular-shaped frame having both ends fastened to the seating part to restrict the circumference of the extension pipe, and a latch hole formed through the frame and into which the securing protrusion is fitted.

7. The vacuum cleaner according to claim 2, wherein the cover is provided with a plurality of wheels.

8. The vacuum cleaner according to claim 6, further comprising:

a cover installed at a portion of the main body where the securing mechanism and the extension pipe are disposed; and an attaching mechanism installed between the securing mechanism and the cover to allow the extension pipe to be detached from or attached to the securing mechanism by manipulation of a user;

wherein the attaching mechanism comprises a through-hole formed on the cover corresponding to the latch hole, a knob retractably installed to the through-hole, and a spring disposed between the knob and the cover.

9. An upright type vacuum cleaner capable of being converted to a canister type, comprising:

a main body having a suction port and a discharge port, and including a suction device inside the suction port;

a suction unit having a dust collecting port and a discharge opening, and on which the main body is detachably installed;

an extension pipe detachably installed to the main body, and having a hollow inner space to define a flow passage into which foreign substances are induced;

a handle installed to an upper end of the extension pipe to form an extend flow passage into which the foreign substances are induced;

a suction hose connected at one end with the suction port, and constructed so as to be capable of selective connection at the other end to each of the discharge opening to allow dust induced into the suction unit to be induced into the main body and with the handle detached from the main body when the vacuum cleaner is converted to the canister type; and a suction head installed to a lower end of the extension pipe when the vacuum cleaner is converted to the canister type.

10. The vacuum cleaner according to claim 9, wherein the handle comprises a handle body installed to the upper end of the extension pipe and adapted to define an extended portion of the flow passage through which the foreign substances are induced; a movement prevention mechanism installed between the handle body and the extension pipe; and a handle cover installed to a front side of the handle body to hold the movement prevention mechanism and the handle body.

11. The vacuum cleaner according to claim 10, wherein the handle body has threads formed around an outer wall of a lower end so as to be fastened by a securing cap of the movement prevention mechanism, and a fastening hole section having a latch groove formed on an inner wall of an upper end of the fastening hole section such that the suction hose is coupled to the fastening hole section to define the extended portion of the flow passage through which the foreign substances are induced.

12. The vacuum cleaner according to claim 10, wherein the movement prevention mechanism comprises seating grooves formed on an upper circumference of the extension pipe, a securing clip fitted into the seating grooves, an insertion hole formed on the handle body and through which the securing clip penetrates, and a securing cap to restrict the handle body and the handle cover enclosing the securing clip and the insertion hole.

13. The vacuum cleaner according to claim 12, wherein the seating grooves comprise a pair of grooves depressed into the upper circumference of the extension pipe, elongated in a horizontal direction, and spaced a predetermined distance from each other.

14. The vacuum cleaner according to claim 12, wherein the securing clip has a C-shape such that both ends of the securing clip are fitted into the seating grooves.

* * * * *